US010378816B2

(12) United States Patent
Delgadillo

(10) Patent No.: US 10,378,816 B2
(45) Date of Patent: Aug. 13, 2019

(54) AIR OVER AIR REFRIGERATION SYSTEM

(71) Applicant: Hector Delgadillo, Duarte, CA (US)

(72) Inventor: Hector Delgadillo, Duarte, CA (US)

( * ) Notice: Subject to any disclaimer, the term of this patent is extended or adjusted under 35 U.S.C. 154(b) by 161 days.

(21) Appl. No.: 15/223,373

(22) Filed: Jul. 29, 2016

(65) Prior Publication Data

US 2017/0261256 A1 Sep. 14, 2017

Related U.S. Application Data

(60) Provisional application No. 62/307,741, filed on Mar. 14, 2016.

(51) Int. Cl.

| | |
|---|---|
| ***F25D 31/00*** | (2006.01) |
| ***F25D 17/06*** | (2006.01) |
| ***F25D 11/02*** | (2006.01) |
| ***A47F 3/04*** | (2006.01) |
| ***A47B 31/02*** | (2006.01) |
| ***A47F 10/06*** | (2006.01) |
| ***F25B 5/02*** | (2006.01) |

(52) U.S. Cl.

CPC ..... *F25D 31/00* (2013.01); *A47B 31/02* (2013.01); *A47F 3/04* (2013.01); *A47F 3/0413* (2013.01); *A47F 10/06* (2013.01); *F25B 5/02* (2013.01); *A47F 3/0452* (2013.01)

(58) Field of Classification Search

CPC ..... F25D 31/00; F25D 31/006; F25D 11/022; F25D 17/06; F25D 25/005; F25D 29/003; F25D 2700/121; F25D 17/065; A47F 3/0413; A47F 3/0452; A47F 3/0456; A47F 3/0482

See application file for complete search history.

(56) References Cited

U.S. PATENT DOCUMENTS 2,418,715 A * 4/1947 Johnson ..... F25D 11/022 62/201
2,836,968 A * 6/1958 Ferris ..... F25D 11/022 312/290
5,168,719 A * 12/1992 Branz ..... F25D 17/065 62/256

(Continued)

*Primary Examiner* — Jianying C Atkisson
*Assistant Examiner* — Tavia Sullens
(74) *Attorney, Agent, or Firm* — Steven A. Nielsen; www.NielsenPatents.com

(57) ABSTRACT

A food prep table may include an upper chilling zone and a lower chilling zone, with each chilling zone containing an evaporation coil system, such as a TurboCoil™ system. The two evaporation coil systems are monitored and controlled by a dual thermostat and control unit (500) having temperature sensor probes in each chilling zone and controlling solenoid valves within each evaporation coil system. By the artful use and implementation of the dual thermostat and control unit, and by the artful use of T junctures in refrigerant supply and return lines, the disclosed embodiments enable a single condensing unit (600) to service both evaporation coil systems to achieve new efficiencies in the cost, refrigeration capacity, and thermal and mechanic attributes of the system. Moreover, an efficient dual air over air flow assembly is disclosed wherein chilled air is moved within the upper chilling zone in a manner that leverages the native configuration and cabinet surface areas of the evaporation coil systems.

1 Claim, 3 Drawing Sheets

(56) References Cited

U.S. PATENT DOCUMENTS

| | | | | |
|---|---|---|---|---|
| 6,089,036 | A * | 7/2000 | Carlson | A47F 3/0447 62/256 |
| 6,109,051 | A * | 8/2000 | Majordy | F25D 11/022 62/258 |
| 6,564,570 | B2 * | 5/2003 | Koike | F25D 11/022 62/258 |
| 6,658,878 | B2 * | 12/2003 | Shim | F25D 11/022 62/131 |
| 2002/0083727 | A1 * | 7/2002 | Koike | F25D 11/022 62/258 |
| 2007/0169505 | A1 * | 7/2007 | Kim | F25D 11/022 62/441 |
| 2011/0209490 | A1 * | 9/2011 | Mijanovic | F24F 11/008 62/190 |

* cited by examiner

AIR OVER AIR REFRIGERATION SYSTEM

CROSS-REFERENCE TO RELATED APPLICATIONS

This is a non-provisional utility application based upon and claiming the priority of provisional application 62/307,741 filed on Mar. 14, 2016. This related patent application is incorporated herein by reference and made a part of this application. If any conflict arises between the disclosure of the invention in this utility application and that in the related application(s), the disclosure in this utility application shall govern. Moreover, the inventor(s) incorporate herein by reference any and all patents, patent applications, and other documents hard copy or electronic, cited or referred to in this application or the related application(s).

COPYRIGHT AND TRADEMARK NOTICE

This application includes material which is subject or may be subject to copyright and/or trademark protection. The copyright and trademark owner(s) has no objection to the facsimile reproduction by any of the patent disclosure, as it appears in the Patent and Trademark Office files or records, but otherwise reserves all copyright and trademark rights whatsoever. Such trademark(s) may include, "Turbo Coil."

BACKGROUND OF THE INVENTION (1) Field of the Invention

The invention generally relates to refrigeration systems. More particularly, the invention relates to means and methods of cooling food products within two separate refrigeration areas using one condensing unit and two separate evaporator coil systems.

(2) Description of the Related Art

The general use of food prep or food preparation tables is known in the related art. Such systems may have a lower section for long term refrigeration wherein public access is not desired and may have an upper section to present chilled food, ready for public access. Such systems often use one condensing unit and one evaporation unit, resulting in an overuse of refrigeration components as the two cooling areas will have thermal dissipation rates and different target temperatures. Thus, there is need in the art for improved refrigeration systems.

Based, in part, by the current inefficiencies of the current food prep table systems, the known related art fails to anticipate or disclose the principles of the present invention.

BRIEF SUMMARY OF THE INVENTION

The present invention overcomes shortfalls in the related art by presenting an unobvious and unique combination and configuration of methods and components to use one condensing unit to service two evaporator coil systems contained within separate cooling compartments. Further shortfalls in the related are overcome by a new upper zone air flow distribution system used in a preparation table application. Moreover, a new top pan system provides numerous food serving options that are easily configurable by the end user.

The presently disclosed embodiments provide new innovations by the use of a digital thermostat system for each of the two refrigeration zones, such that a single condensing unit may be enabled.

The presently disclosed embodiments provide new innovations by the artful placement of evaporator coil components or Turbo Coil™ evaporator coil/blower systems to facilitate the disclosed upper air flow distribution system for a preparation table application and by the artful placement of evaporator coil components to facilitate cooling in the lower refrigeration zone. The two placements or positions of the evaporator coil components not only enable new air flow distribution systems by also enable efficient accessing and servicing of the evaporator coil components.

For example, for the upper cooling system, the evaporator coil components or patented Turbo Coil system is placed at an end of the prep table, such that the evaporator coil components are easily accessible at the edge of the table and such that the upper section of the evaporator coil system blows cooled air in a first cool air channel of the prep table and such that the lower section of the evaporator coil system accepts return air as a result of the artful integration of the evaporator coil system and the design of the prep table airflow system. The presently disclosed embodiments leverage the native design of the evaporator coil system and blower system to efficiently supply cooled air to the cool air intake channel of the prep table while efficiently accepting the warmed return air at the lower portion of the evaporator coil system. The artful design of the disclosed prep table airflow system allows for a seamless integration with the upper evaporator coil/blower system or TurboCoil system such that extra vents or air ducts are not needed. The evaporator coil system may be directly secured to the native vent system or air flow system of the new prep table.

The new upper air flow distribution system of the upper cooling system or prep table system includes an upper lip section or upper lip channel that accepts cooled air directly from the evaporator coil system. The upper lip channel then leads to a horizontal cooling channel that intersects with the plurality of food pans disposed within the upper cooling area. The plurality of food pans are interchangeable and may be toolessly adjusted or reconfigured to accommodate any desired presentation of cooled food. On an opposite or distal end of the prep table area, a distal and vertical cool air end channel rises to a point adjacent to the upper edge of the table and reaches a horizontal pass through channel before connecting to a downward, vertical and distal return air channel. The distal and vertical return air channel is connected to and leads to a horizontal return air channel which leads to a proximal and downwardly vertical return air channel. The disclosed embodiments overcome shortfalls in the art as the proximal and downwardly vertical return air channel may be partially or defined by the outer and lower edges of the evaporator coil system. The integration of the evaporator coil system overcomes shortfalls in the art by negating the use of further vents or ducts, as the evaporator coil system itself is used to create the needed duct work.

Disclosed embodiments include a sealed lower refrigeration zone or compartment and a separate upper cooling zone which may comprise the new upper zone air flow distribution system. Disclosed embodiments may be referred to as a dual zone prep table.

Disclosed embodiments may include the use of a lower sensor probe and an upper sensor probe which may be connected to a new dual thermostat with the new dual thermostat controlling an upper solenoid valve and a lower solenoid value, with the solenoid values independently controlling the operation of the two evaporator coil systems. These new control systems enable the artful and efficient use of just one condensing unit to service two independent evaporator coil systems.

Sensors of the dual thermostat sense the individual temperatures of each refrigeration compartment. Based upon the measured temperatures, the dual thermostat controls solenoid values connected to the evaporator coils and the solenoid values regulate the entry of refrigerant to enter the TXV's and the evaporator coils to achieve the desired temperatures within the refrigeration compartments.

The dual thermostat allows for each refrigeration compartment to be set to a different target temperature.

The disclosed embodiments overcome shortfalls in the related art, wherein the related art includes systems with one evaporator coil system to cool both a base and top section of a prep table, often resulting in insufficient cooling or system break downs due to overuse.

Disclosed embodiments include a process wherein:

1. A singular condensing unit transmits refrigerant to a lower and an upper evaporation coil, with each evaporation coil disposed within an upper or lower refrigeration zone or refrigeration compartment.

2. Refrigerant returns from both evaporation coils in order to complete the traditional refrigerant treatment cycle within the condensing unit.

3. A dual thermostat senses individual temperatures from within each refrigerated zone and controls solenoid valves allowing the needed refrigerant to enter the TXV's and the evaporator coils to regulate the temperatures set on the dual thermostat for each refrigerated zone.

These and other objects and advantages will be made apparent when considering the following detailed specification when taken in conjunction with the drawings.

REFERENCE NUMERALS IN THE DRAWINGS

Figure 1:
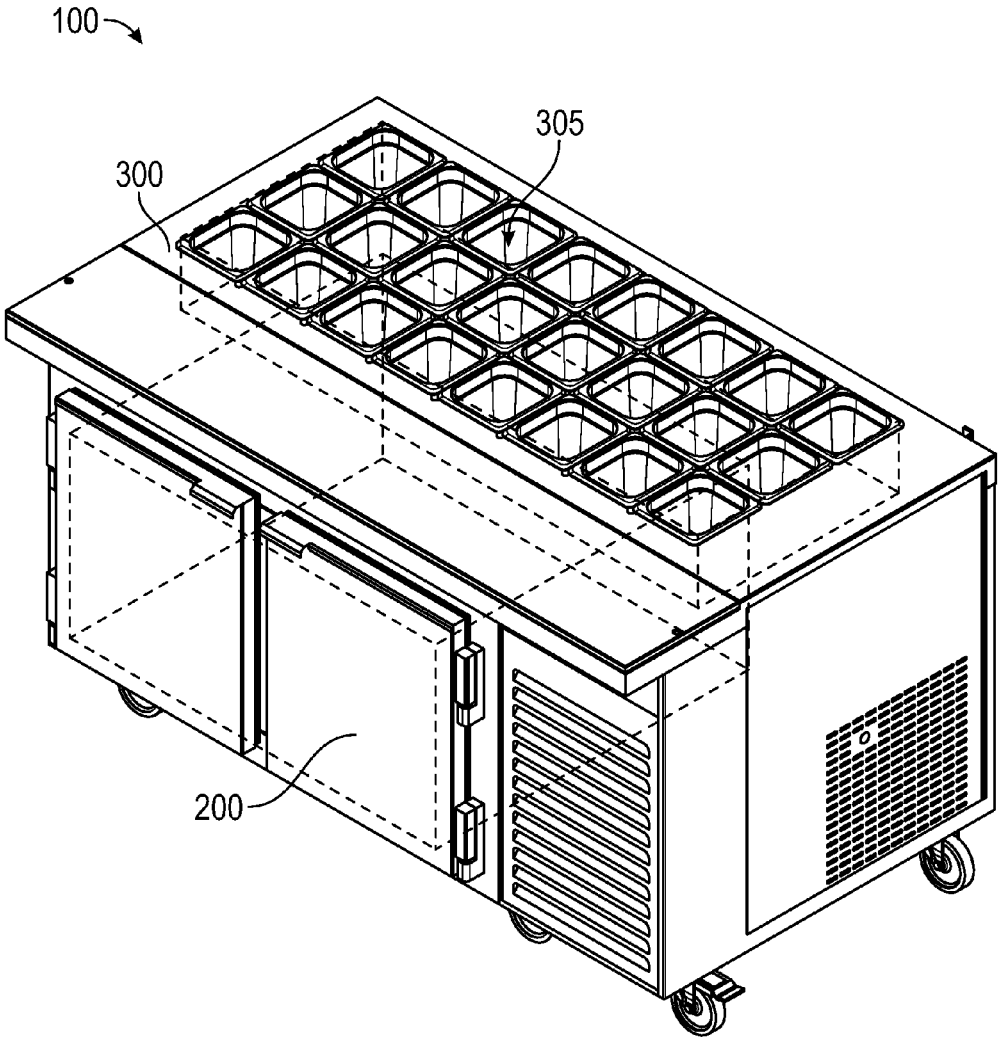
FIG. 1 depicts a perspective view of a disclosed embodiment

100 food preparation or serving table in general
200 lower refrigeration compartment or lower cooling zone
300 upper refrigeration compartment or upper cooling zone
305 removable food pans or food containers
307 proximal food container
308 proximal vertical lateral wall of a proximal food container
310 proximal vertical wall of upper refrigeration compartment 300
315 proximal vertical cooling channel or void of upper refrigeration system 300
320 horizontal barrier or wall within lower portion of the upper refrigeration compartment 300
325 lower horizontal channel for cooled air within the upper refrigeration compartment 300
327 distal food container
329 lateral vertical wall of distal food container 327
330 distal vertical wall within upper refrigeration compartment 300
335 distal vertical channel within upper refrigeration compartment 300
337 distal vertical return channel
339 outer lateral distal wall of distal vertical return channel 337
341 lower horizontal barrier of table
343 lower horizontal return air channel
345 proximal vertical return air channel
347 proximal vertical wall of vertical return air channel 345
349 proximal horizontal return air channel
351 proximal horizontal bottom wall
353
400 lower evaporation coil system
401 solenoid valve of lower evaporation coil system
450 upper evaporation coil system
451 solenoid valve of upper evaporation coil system
455 upper front panel of upper evaporation coil system 450
457 lower side panel of upper evaporation coil system 450
460 return air duct of upper evaporation coil system 450
500 dual thermostat and control unit
505 line to lower sensor probe
507 lower sensor probe
510 line to lower solenoid valve
515 line to upper sensor probe
517 upper sensor probe
520 line to upper solenoid valve
600 condensing unit
610 refrigerant or Freon supply line
615 T juncture of refrigerant supply line 610 leading to both the upper and lower evaporation coil systems
620 refrigerant return line
625 T juncture of refrigerant return lines from both the upper and lower evaporation coil systems

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

FIG. 1 depicts a perspective view of a disclosed embodiment which may comprise a lower cooling zone 200 or lower refrigeration compartment. The lower refrigeration compartment may be sealed or separate from the upper zone or upper refrigeration compartment. The lower cooling zone may contain a condensing unit and a lower evaporation coil system 400. The lower or upper evaporation coils systems are not limited to any particular system and may comprise a Turbo Coil system.

The separate nature of the lower cooling zone and upper cooling zone overcomes shortfalls in the art as food contained within the lower cooling zone may be kept separate and at a different temperature from food chilled and presented in the upper cooling zone.

Figure 2:
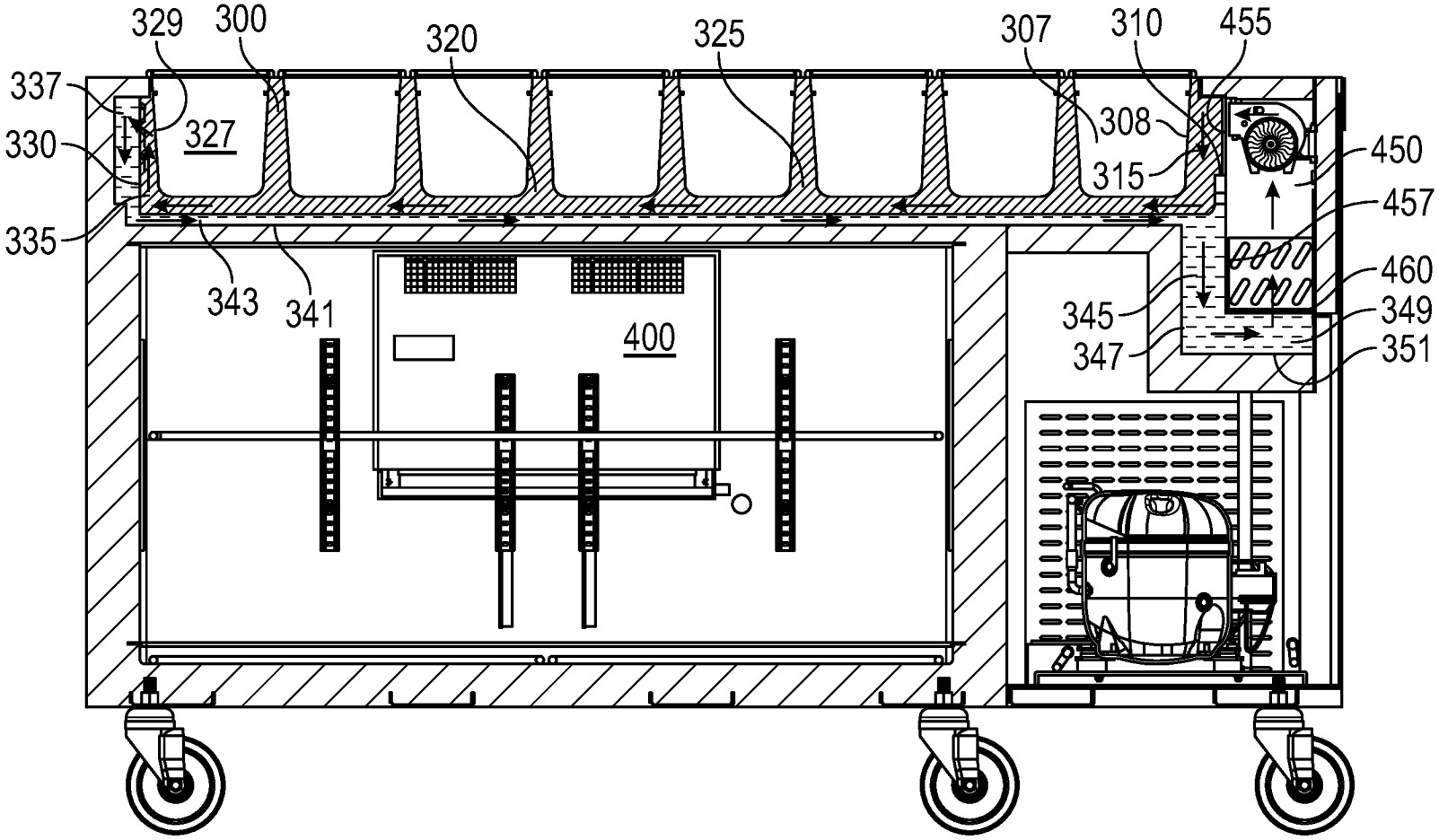
FIG. 2 depicts a sectional view of a disclosed embodiment

FIG. 1 depicts a plurality of food pans 305 that may take the form of any shape and may be mixed with different shapes to comport with serving needs. As shown in FIG. 2, cool air may circulate between the vertical walls of the pans to enable uniform cooling.

FIG. 2 depicts a sectional view of a disclosed embodiment and illustrates various unique and new means and methods of air flow distribution and illustrates the separateness of the lower and upper cooling zones.

FIG. 2 depicts an upper evaporation coil system 450. For ease of reference, components found near the upper evaporation coil system may be referred to as "proximal" or "close" while components found at or near the other end of the prep table may be referred to as "distal" or "distant."

The disclosed upper air flow distribution system overcomes many shortfalls in the art as chilled air flow is directed towards upper portions near or upon the food pans and warmed air is directed under the chilled air flow to present a compact air flow system. The disclosed air flow system also leverages the native attributes of a evaporation coil system such as a Turbo Coil system wherein upper portions of the evaporation coil system generating chilled air fit directly into the upper chilled air paths while warmed air or return air is channeled at a lower level, directly into the native return air intakes of the evaporation coil system. In some instances, the outer panels of an evaporation coil system may define various air channels, creating a new found efficiency in directing air flow. The use of both longitudinal sides of a lower horizontal barrier 341 creates a new efficiently in that the top side helps to define a horizontal channel for cooled air 325 while the bottom side of the barrier 341 defines the upper wall of the lower horizontal return air channel 343.

The disclosed upper air flow distribution system, starting at the proximal side or side near the upper evaporation coil system 450 may start at the upper end of the upper evaporation coil system and may be followed by the arrows upon FIG. 2. Chilled air is blown out of the evaporation coil system and forced in a downward direction within a proximal vertical cooling channel 315, the proximal vertical cooling channel 315 may be defined by outer portions of the upper evaporation coil system 450 and a proximal vertical lateral wall 308 of a proximal food container 307. Chilled air may then flow within a lower horizontal channel 325 defined by the outer edges of the food pans and by the horizontal barrier 320. After chilled air has moved past and/or upon the food pans, the chilled air is directed in a an upward vertical direction along a distal vertical channel 335, with the distal vertical channel 335 defined by the lateral vertical wall 329 of distal food container 327 and by the 330 distal vertical wall. Chilled air may pass over the top edge of the distal vertical wall and then pass down the distal vertical return channel 337. Return air may then pass within a lower horizontal return air channel 343, defined within the lower horizontal barrier 341 and the bottom side of the horizontal barrier 320. Return air may then pass downwardly into the proximal vertical return air channel 345 and then to the proximal horizontal return air channel 349 before reaching a return inlet of the upper evaporation coil system 450.

Figure 3:
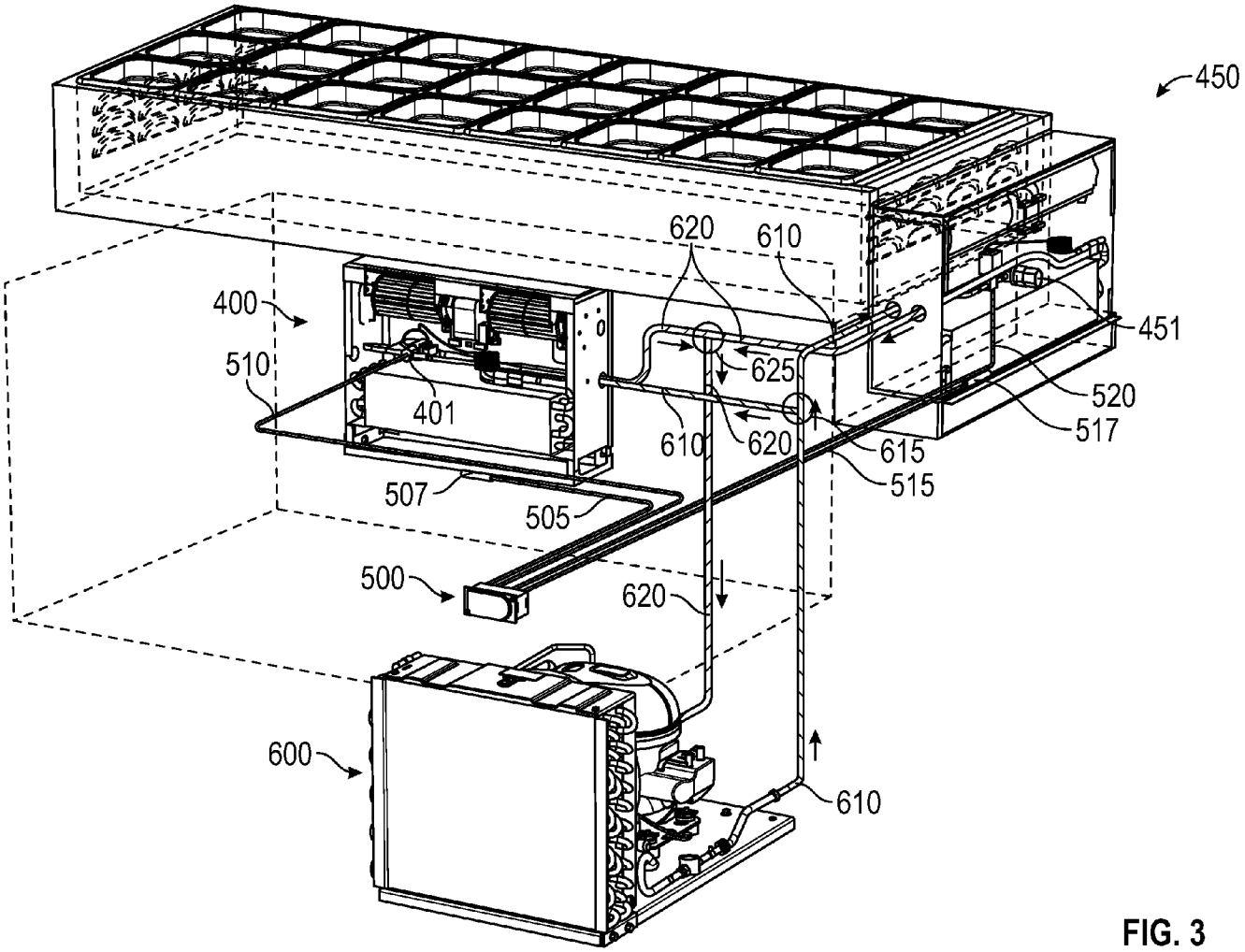
FIG. 3 depicts a perspective view of disclosed components

FIG. 3 depicts components comprising a unique and efficient cooling system wherein a condensing unit 600 services refrigerant supply and returns from both the lower evaporation coil system 400 and the upper evaporation coil system 450 by use of a new and unique digital dual thermostat and control unit 500. The digital dual thermostat and control unit 500 may comprise a line of electrical 505 communication to a lower sensor probe 507, a line 515 to an upper sensor probe attached to an upper sensor probe 517. The digital dual thermostat and control unit may further comprise a command and control line 520 to a solenoid valve 451 of the upper evaporation coil system 450 and a line 510 to the lower evaporation coil system to control a lower solenoid value 401. The solenoid valves may control input to a TXV of a respective evaporation coil system. By the artful use of the command and control lines solenoid valves control the input of conditioned refrigerant supply as a corresponding temperature probe sends temperature information to the digital dual thermostat and control unit 500.

The disclosed condensing unit 600 may comprise a refrigerant supply line 610 leading to both upper and lower evaporation coils systems. Efficiencies are gained by the sharing of refrigerant supply and return lines between the upper and lower evaporation coils systems. The initial refrigerant supply line 610 leads to a T juncture 615 wherein further refrigerant supply lines lead to the upper and lower evaporation coil systems.

Refrigerant return lines 620 from each of the evaporation coils systems may meet at a T juncture 625 before funneling into one return line 620 and reaching the condensing unit 600.

Items

Disclosed embodiments may include the following items.

A food preparation table and refrigerant system (100) the table and system comprising:

a) an enclosed lower refrigeration compartment (200) containing a condenser (600) and a lower evaporation coil system (400);

b) upper refrigeration compartment (300) disposed over the lower refrigeration compartment;

c) a upper evaporation coil system (450) attached to the upper refrigeration compartment, the upper evaporation coil system comprising an upper chilled air outlet disposed inwardly toward and into the upper refrigeration compartment and the upper evaporation coil system comprising a lower return air inlet disposed below the air outlet;

d) the condenser comprising a refrigerant supply line (610) leading to a T juncture (615) with the T juncture leading to two refrigerant supply lines with each line leading to either the upper or lower evaporation coil system;

e) the condenser further comprising a refrigerant return line 620 leading to a T juncture with the T juncture accepting a refrigerant return line from the upper and lower evaporation coil system.

f) a dual thermostat and control unit (500) comprising a line (505) to a lower sensor probe (507) and a line (515) to an upper sensor probe (517);

g) the dual thermostat and control unit further comprising a line (510) to a solenoid value attached to a TXV of the lower evaporation coil system and a line (520) to the upper evaporation coil system.

l) the dual thermostat and control unit operating the two solenoids so as to regulate the supply of refrigerant to the upper and lower evaporation coils systems.

Item 2. The table and refrigerant system of 1 further including an air flow system within the upper refrigeration compartment.

Item 3. The table and refrigerant system of 2 wherein the air flow system originates from a chilled air outlet of the upper evaporation coil system (450) wherein the chilled air outlet leads to a proximal vertical cooling channel (315) wherein chilled air then leads to a lower horizontal channel (325) passing under and between a plurality of food pans (305), wherein the chilled air passes up a distal vertical channel (335), wherein the chilled air may be considered return air as the return air passes into a distal vertical return channel (337), wherein the return air passes through a lower horizontal return air channel (343), wherein the return air moves downwardly into a proximal vertical return air channel (345) wherein the return air moves to a proximal horizontal return air channel (349) before reaching a return air duct (460) of the upper evaporation coil system.

What is claimed is:

1. A food preparation table with plurality of food pans and refrigerant system (100) the table and system comprising:

a) an enclosed lower refrigeration compartment (200) containing a condenser (600) and a lower evaporation coil system (400);

b) an upper refrigeration compartment (300) disposed over the lower refrigeration compartment the enclosed lower refrigeration compartment fluidly isolated from the upper refrigeration compartment;

c) an upper evaporation coil system (450) attached to the upper refrigeration compartment, the upper evaporation coil system comprising an upper chilled air outlet in fluid communication with the upper refrigeration compartment and the upper evaporation coil system comprising a lower return air duct (460) disposed below the air outlet;

d) the condenser comprising a refrigerant supply line (610) leading to and in fluid communication with a first T juncture (615), with the first T juncture leading to and in fluid communication with two refrigerant supply lines, with a first line of the two refrigerant supply lines leading to and in fluid communication with the upper evaporation coil system and a second line of the two refrigerant supply lines leading to and in fluid communication with the lower evaporation coil system;

e) the condenser further comprising a refrigerant return line (620) leading from and in fluid communication with a second T juncture (625), with the second T juncture accepting from and in fluid communication with a refrigerant return line from each of the upper and lower evaporation coil system;

f) a dual thermostat and control unit (500) comprising a line (505) to and in communication with a lower sensor probe (507) and a line (515) to an upper sensor probe (517);

g) the dual thermostat and control unit further comprising a line (510) to a solenoid valve (401) attached to a Thermal Expansion Valve of the lower evaporation coil system and another line (520) to a solenoid valve (451) attached to a Thermal Expansion Valve of the upper evaporation coil system; and h) the dual thermostat and control unit configured to operate the two solenoids so as to regulate the supply of refrigerant to the upper and lower evaporation coil systems;

l) an airflow system within the upper refrigeration compartment, wherein the airflow system comprises, in fluid communication: the chilled air outlet of the upper evaporation coil system (450), a proximal vertical cooling channel (315), a lower horizontal channel (325) that passes under and between the plurality of food pans (305), a distal vertical channel (335), a distal vertical return channel (337) defined from the distal vertical channel (335) by a distal vertical wall (330), a lower horizontal return air channel (343), a proximal vertical return air channel (345), a proximal horizontal return air channel (349), and the return duct (460) of the upper evaporation coil system; the airflow system configured such that chilled air flows from the chilled air outlet of the upper evaporation coil system (450) downward through the proximal vertical cooling channel (315) to the lower horizontal channel (325) under and between the plurality of food pans (305), upward through the distal vertical channel (335) over a top edge of the lateral vertical wall (330) and into the distal vertical return channel (337), where the chilled air is considered return air, the return air then flows downward through the distal vertical return channel (337), through the proximal horizontal return air channel (349), downward through the proximal vertical return air channel (345) and to the proximal horizontal return air channel (349) before reaching the return air duct (360) of the upper evaporation coil system.

* * * * *